United States Patent [19]

Pryor et al.

[11] 3,941,620

[45] Mar. 2, 1976

[54] METHOD OF PROCESSING COPPER BASE ALLOYS

[75] Inventors: Michael J. Pryor; Jacob Crane, both of Woodbridge; Sam Friedman; Eugene Shapiro, both of Hamden, all of Conn.

[73] Assignee: Olin Corporation, New Haven, Conn.

[22] Filed: Dec. 18, 1974

[21] Appl. No.: 534,015

Related U.S. Application Data

[63] Continuation-in-part of Ser. No. 487,470, July 11, 1974.

[52] U.S. Cl. ..... 148/12.7; 148/2; 148/11.5 C

[51] Int. Cl.[2] ..... C22F 1/08

[58] Field of Search ..... 148/11.5 R, 12.7, 2, 32, 148/32.5; 75/154

[56] References Cited

UNITED STATES PATENTS

| | | | |
|---|---|---|---|
| 1,928,747 | 10/1933 | Wise | 75/154 |
| 3,522,112 | 7/1970 | McLain | 148/12.7 |

*Primary Examiner*—R. Dean

*Attorney, Agent, or Firm*—Robert H. Bachman; David A. Jackson

[57] ABSTRACT

Method of processing nickel-tin containing copper base alloys in order to obtain an improved combination of strength and bend properties. The alloys processed herein contain from 7 to 14% nickel and from 1.5 to 3.3% tin.

11 Claims, No Drawings

METHOD OF PROCESSING COPPER BASE ALLOYS

CROSS-REFERENCE TO RELATED APPLICATION

This application is a continuation-in-part of copending application Ser. No. 487,470 for "Improved Copper Base Alloy" by Pryor et al., filed July 11, 1974.

BACKGROUND OF THE INVENTION

Copper base alloys containing nickel and tin are known in the art. For example, the commercial copper alloy 725 is a copper-nickel containing 8.5 to 10.5% nickel and 1.8 to 2.8% tin. It is highly desirable to provide alloys of this general type with a good combination of strength and bend properties. It is particularly desirable to provide a process for improving the combination of strength and bend properties in these alloys while obtaining other advantageous properties, such as good solderability and good contact resistance. Commercial alloys of this general type are characterized by deficiencies in one or more of the foregoing characteristics.

Accordingly, it is a principal object of the present invention to provide a process for obtaining a combination of good strength and good bend properties in the tin and nickel containing copper alloys.

It is a further object of the present invention to provide a process as aforesaid which is convenient to use on a commercial scale and which obtains other desirable properties in these alloys, such as good shelf life solderability and good contact resistance.

Further objects and advantages of the present invention will appear hereinbelow.

SUMMARY OF THE INVENTION

In accordance with the present invention it has now been found that the foregoing objects and advantages may be readily obtained. The process of the present invention relates to processing copper base alloys wherein the alloy consists essentially of nickel from 7 to 14% and tin from 1.5 to 3.3%, with the balance essentially copper. In the preferred embodiment, the alloy processed in accordance with the present invention contains either iron from 0.1 to 3% or cobalt from 0.1 to 3% or mixtures thereof, with the minimum iron plus cobalt content preferably being 1.0%.

In accordance with the process of the present invention, a good combination of strength and bend characteristics are obtained by processing as follows:

A. providing a completely recrystallized, wrought copper base alloy containing 7 to 14% nickel, 1.5 to 3.3% tin and the balance essentially copper;
B. cold rolling with a reduction of 20 to 50%;
C. aging at a temperature of from 300° to 550°C for 15 minutes to 24 hours; and
D. cold rolling with a reduction of from 20 to 55%, wherein the total reduction of said recrystallized alloy is less than about 65%.

If desired, one may provide the recrystallized, wrought copper alloy in step (A) by hot rolling the alloy with a finishing temperature in excess of 650°C. Naturally, in this embodiment the total reduction following the recrystallization should be less than 65%. This embodiment is useful if gage requirements make it desirable to go directly to cold rolling step (B) following hot rolling.

Alternatively, one may provide the recrystallized, wrought copper alloy in step (A) by: hot rolling the alloy with a finishing temperature in excess of 550°C; and cold rolling and annealing so that the alloy is completely recrystallized following the annealing step, with the amount of cold reduction being preferably at least 20% and with the annealing temperature being in the range of 600° to 850°C for at least one minute. Naturally, the total reduction following the recrystallization annealing step should be less than about 65%.

DETAILED DESCRIPTION

The process of the present invention deals with copper base alloys containing from 7 to 14% nickel and from 1.5 to 3.3% tin. In accordance with the preferred embodiments, the minimum nickel plus tin content is 9.5% and the nickel content is in the range of 9 to 11% and the tin content is in the range of 2 to 3%, with the minimum nickel plus tin content being preferably 11.5%. The minimum nickel plus tin content is employed in order to obtain good strength characteristics.

In accordance with the process of the present invention it has been found that particularly surprising improvements are obtained when the foregoing alloys contain either iron from 0.1 to 3% or cobalt from 0.1 to 3% or mixtures thereof, with the preferred ranges of these materials being from 0.5 to 3% each. This surprising improvement is even more pronounced when the minimum iron plus cobalt content is 1% and preferably 1.5%. The minimum iron plus cobalt content aids in grain refinement, the resultant alloys of the present invention having a fine grain size below 0.025 mm. A fine grain size provides good strength characteristics at a given cold reduction. In addition, in the iron-cobalt containing alloys particularly, it has been found that a surprising combination of good strength properties may be obtained combined with surprisingly good bend properties, solderability and contact resistance. It is believed that the process of the present invention particularly in the iron-cobalt containing alloys promotes the formation of a fine, uniformly dispersed phase which is magnetic and which contains nickel plus iron and/or cobalt. The minimum iron plus cobalt content is necessary for the precipitation of sufficient magnetic phase to obtain desirable properties. It is believed that this magnetic phase significantly contributes to the surprising properties achieved in accordance with the process of the present invention.

The balance of the alloy processed in accordance with the present invention is essentially copper. Naturally, conventional impurities are contemplated and additives may be incorporated in order to accentuate a particular property. Generally normal brass mill impurities may be tolerated in the alloys, but should preferably be kept at a minimum. For example, phosphorus should preferably be maintained below 0.1%, lead below 0.05% and sulfur below 0.05% to preclude the possibility of interference with hot processing. Typical additives which may be included are manganese up to 0.5%, magnesium up to 0.1%, and small amounts of calcium, chromium, zirconium, titanium and misch metal.

The higher ranges of iron plus cobalt, particularly in excess of 3% of each of these materials, may impair ductility and hot workability. Accordingly, one should restrict the upper limit of iron and/or cobalt to 3% in order to minimize this problem.

As indicated above, a particularly significant feature of the alloy prepared in accordance with the process of the present invention is the presence of the fine dispersed phase which is magnetic and which contains iron and/or cobalt. The magnetic phase is submicroscopic and not optically observable at a magnification of 1000×. Clearly the magnetic phase is not an aggregate phase as it would then be optically resolvable; therefore, the magnetic phase must be a dispersed phase. The resultant alloys exhibit increased magnetic attraction with aging. Hence, one must obtain precipitation of magnetic particles upon aging. It is significant that no magnetic effect is obtained in the same composition without the iron and/or cobalt addition.

The alloys may be cast in any desired manner, for example, Durville or DC casting. A sufficient melting temperature is required in order to insure that all components are in solution and uniformly mixed. It is preferred that the minimum melting temperature be at least 1,250°C and preferably at least 1,275°C. The minimum casting temperature should be at least 1,150°C to avoid segregation and promote homogeneity. Inadequate casting temperature may promote the formation of undesirable coarse particles of iron and cobalt which may interfere with ductility, reduce the available amounts of iron and/or cobalt for the subsequent formation of the magnetic phase, and may represent sites for finishing defects and premature failure. Rapid cooling rate during casting is also desirable, particularly in the range of from about 1,150° to 1,090°C.

After casting, the alloy is hot rolled in order to break up the cast structure. The amount of hot rolling reduction is not critical and the starting hot rolling temperature is not critical provided that incipient melting does not occur. Generally, starting hot rolling temperatures of from 850° – 975°C are sufficient to insure the absence of incipient melting. One should hot roll the alloy so that one does not finish hot rolling below about 550°C since finishing hot rolling below 550°C promotes excessive production of a second phase of nickel and tin which tends to impair ductility.

In accordance with one embodiment of the present invention, after hot rolling as aforesaid with a finishing temperature above 550°C, the process of the present invention may cold roll and anneal so that the alloy is completely recrystallized following the annealing step. This is a particularly significant feature of the process of the present invention. If complete recrystallization is not obtained following the cold rolling and annealing sequence, one does not obtain the maximum combination of strength and bend properties. High strength may be obtained without complete recrystallization; however, the bend properties would be impaired. The amount of cold reduction in this step is at least 20% and preferably in the range of 40 to 70%. The annealing temperature is in the range of 600° to 850°C for at least 1 minute, with the actual annealing time being sufficient to cause complete recyrstallization. The preferred annealing conditions are at a temperature of 650° to 750°C for at least 15 minutes.

In accordance with another embodiment of the present invention, one may omit the cold rolling and recrystallization annealing step by hot rolling with a finishing temperature in excess of 650°C so that the alloy is completely recrystallized following the hot rolling step.

After the recrystallization step, an additional cold reduction is taken with a reduction of from 20 to 50%.

This is followed by an aging step at a temperature of 300° to 550°C, and preferably from 300° to 500°C, for from 15 minutes to 24 hours. After the aging step the alloy is cold rolled with a reduction of from 20 to 55%. The cold reduction prior to aging creates nucleation sites for more effective distribution of the magnetic phase, the distribution of which is promoted by aging. In addition, the cold reduction creates nucleation sites for more effective distribution of other phases, as the aforementioned nickel-tin phase which should be distributed throughout the matrix. It has been found that in accordance with the process of the present invention that the total reduction following the recyrstallization step must be less than 65% in order to obtain the good combination of strength and bend properties which characterize the process of the present invention and to obtain the maximum strength and bend properties.

Optionally, one may provide an additional aging step at a temperature of from 300° to 500°C for 15 minutes to 24 hours. This additional aging step increases the yield properties and elongation. In addition, one may optionally follow this aging step with a further cold reduction, with the proviso that the total cold reduction following the recrystallization should be less than 65%.

The process of the present invention and improvements resulting therefrom will be more readily apparent from a consideration of the following illustrative examples.

EXAMPLE I

A series of alloys were prepared having the composition set forth in Table I below.

TABLE I

| Alloy | % Ni | % Sn | % Fe | % Co | % Cu |
|---|---|---|---|---|---|
| A | 9.5 | 2.3 | 2 | | Bal. |
| B | 9.5 | 2.3 | 2.3 | | Bal. |
| C | 9.5 | 2.3 | 1 | 1 | Bal. |
| D | 9.5 | 2.3 | | 2 | Bal. |

Alloy B was Durville cast and Alloys A, C and D were DC cast. The melting temperature for the Durville and DC castings was about 1,300°C, the casting temperature for the Durville castings was between 1,200° and 1,275°C, and the casting temperature for the DC castings was about 1,200°C.

EXAMPLE II

Alloys A and C were processed in the following manner. The alloys were hot rolled from a thickness of about 3 to about 0.4 inch at a starting temperature of 950°C and a finishing temperature of about 600°C. The alloys were surface milled to produce a clean surface followed by cold rolling to 0.080 inch gage and annealing at a temperature of from 650° to 675°C for 1 hour in order to obtain complete recrystallization. The materials were cold rolled 50% to 0.040 inch gage. One sample of each alloy was chemically etched to 0.032 inch gage and one sample of each alloy was chemically etched to 0.029 inch gage. Both samples of each alloy were aged at 400°F for 16 hours followed by cold rolling to 0.020 inch gage.

The strength and bend properties of these alloys are shown in Table II below. The degree of cold reduction after annealing is clearly shown in Table II below to be a critical factor in attaining excellent bad way bend properties in association with high strength. The bad way bend properties vary markedly over a 5% range in total reduction after recrystallization, while the strength is insensitive over this range. The bend test compares the bend characteristics of samples bent over increasingly sharper radii until fracture is noted. The smallest radius at which no fracture is observed is called the minimum bend radius. When the bend axis is perpendicular to the rolling direction, it is called "good way bend," and parallel to the rolling direction is called the "bad way bend."

TABLE II

| Alloy | Gage | % Reduction after Recrystallization | Ultimate Tensile Strength ksi | 0.2% Yield Strength ksi | Minimum Bend Radius, 64ths. Good Way | Bad Way |
|---|---|---|---|---|---|---|
| A | .020" | 70 | 124 | 117 | 3 | 7 |
| A | .020" | 65 | 121 | 114 | 3 | 4 |
| C | .020" | 70 | 125 | 118 | 3 | 7 |
| C | .020" | 65 | 125 | 119 | 3 | 4 |

EXAMPLE III

Alloys B and C were processed in accordance with the processing of the present invention of Example II and were tested for shelf life solderability and shelf life contact resistance. The shelf life solderability was determined as measured in a standardized dip test using four quality classifications. In this classification series, Class 1 indicates the best solderability and Class 4 the poorest. Two flux conditions were used, the 100 flux being a milder less aggressive flux than the 611 flux. The data is described in Table IIIA below wherein each alloy was tested after a shelf time of zero hours, 2,500 hours, and 5,000 hours. It can be seen that in all cases the shelf life solderability after the process of the present invention remains good.

In addition, the shelf life contact resistance of Alloys B and C were tested by determining the contact resistance of contact area between the sample surface and a spherically shaped contacter by measuring at various contact pressures between the two. Low values of contact resistance are desirable. The data is shown in Table IIIB below after a shelf time of 3,500 hours for Alloy B and shelf time of 6,000 hours for Alloy C. It can be seen that desirably low values are obtained.

TABLE IIIA

| Alloy | Shelf Time (hrs.) | Solderability Class 100 Flux | 611 Flux |
|---|---|---|---|
| B | 0 | 2 | 2 |
| B | 2500 | 3 | 2 |
| B | 5000 | 3 | 3 |
| C | 0 | 2 | 2 |
| C | 2500 | 3 | 3 |
| C | 5000 | 3 | 3 |

TABLE IIIB

| Alloy | Shelf Time (hrs.) | Contact Resistance (OHMS) at Load (GMS) 20 | 50 | 100 | 200 | 1000 |
|---|---|---|---|---|---|---|
| B | 3500 | .11 | .089 | .074 | .059 | .025 |
| C | 6000 | — | .067 | .047 | .031 | .023 |

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A method for processing copper base alloys to provide good strength and bend characteristics which comprises:

A. providing a completely recrystallized, wrought copper base alloy consisting essentially of 7 to 14% nickel, 1.5 to 3.3% tin and the balance copper;

B. cold rolling with a reduction of 20 to 50%;

C. aging at a temperature of from 300° to 550°C for 15 minutes to 24 hours; and

D. cold rolling with a reduction of from 20 to 55%, wherein the total reduction of said recrystallized alloy is less than about 65%.

2. A method according to claim 1 wherein said recrystallized, wrought copper alloy is provided in step (A) by hot rolling the alloy with a finishing temperature in excess of 650°C, and wherein the total reduction following recrystallization in steps (B) and (D) is less than about 65%.

3. A method according to claim 1 wherein said recrystallized, wrought copper alloy is provided in step (A) by: hot rolling the alloy with a finishing temperature in excess of 550°C; and cold rolling and annealing so that the alloy is completely recrystallized following the annealing step, with the amount of cold reduction being at least 20% and with the annealing temperature being in the range of 600° to 850°C for at least 1 minute, wherein the total reduction following the recrystallization annealing step is less than about 65%.

4. A process according to claim 1 wherein said copper base alloy contains a material selected from the group consisting of iron from 0.1 to 3%, cobalt from 0.1 to 3% and mixtures thereof.

5. A process according to claim 4 wherein the minimum iron plus cobalt content is 1.0%.

6. A process according to claim 3 wherein said alloy is given a cold reduction of from 40 to 70% prior to said recrystallization annealing step.

7. A process according to claim 3 wherein said recrystallization annealing step is at a temperature of from 650° to 750°C for at least 15 minutes.

8. A process according to claim 1 wherein the minimum nickel plus tin content is 9.5%.

9. A process according to claim 8 wherein said copper alloy has a nickel content from 9 to 11%, a tin content of from 2 to 3% and a minimum nickel plus tin content of 11.5%.

10. A process according to claim 1 including the following additional step E.: aging at a temperature of from 300° to 500°C for 15 minutes to 24 hours.

11. A process according to claim 10 including an additional cold reduction step (F) following aging step (E), provided that the total cold reduction of said recrystallized alloy is less than about 65%.

* * * * *